US010051906B1

(12) United States Patent
Kazmierczak

(10) Patent No.: US 10,051,906 B1
(45) **Date of Patent: *Aug. 21, 2018**

(54) HEADWEAR WITH WATER/PERSPIRATION HANDLING FEATURES

(71) Applicant: Alex Kazmierczak, Seattle, WA (US)

(72) Inventor: Alex Kazmierczak, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/339,246

(22) Filed: Oct. 31, 2016

Related U.S. Application Data

(63) Continuation-in-part of application No. 14/216,941, filed on Mar. 17, 2014, now Pat. No. 9,480,292.

(60) Provisional application No. 61/798,639, filed on Mar. 15, 2013.

(51) Int. Cl.

| | |
|---|---|
| ***A42B 1/18*** | (2006.01) |
| ***A42B 1/00*** | (2006.01) |
| ***A42B 3/00*** | (2006.01) |

(52) U.S. Cl.
CPC ..... *A42B 1/008* (2013.01); *A42B 3/00* (2013.01)

(58) Field of Classification Search
CPC .. A42C 5/04; A42B 1/02; A42B 1/205; A42B 1/062; A42B 1/066; A42B 3/28
See application file for complete search history.

(56) References Cited

U.S. PATENT DOCUMENTS 9,480,292 B1 * 11/2016 Kazmierczak ..... A42C 5/04

* cited by examiner

*Primary Examiner* — Bobby Muromoto, Jr.
(74) *Attorney, Agent, or Firm* — Christensen O'Connor Johnson Kindness PLLC

(57) ABSTRACT

A head covering, such as hats, visors, bandanas, etc., which includes a perspiration removal system.

20 Claims, 12 Drawing Sheets

HEADWEAR WITH WATER/PERSPIRATION HANDLING FEATURES

CROSS-REFERENCE TO RELATED APPLICATION

This application is a continuation-in-part of U.S. patent application Ser. No. 14/216,941, filed Mar. 17, 2014, which claims the benefit of U.S. Provisional Application No. 61/798,639, filed Mar. 15, 2013, the disclosures of which are hereby incorporated in their entirety.

BACKGROUND

As generally known, head coverings provide many benefits to the wearer. For example, head coverings, such as hats, provide shade to protect the user's head from the direct rays of the sun. Such shade reduces glare to the wearer's eyes, protects certain areas of the wearer's body from sunburn, may reduce the effects of heat to the wearer, etc. In other instances, head coverings may protect the wearer from rain, sleet, snow, and other precipitation, and/or may provide protection from the cold, wind, etc.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a head covering is provided. The head covering includes an inner wall section and an outer wall section disposed radially outwardly of the inner wall section and coupled thereto in order to form a channel. A flexible seal member is also provided in some embodiments. The flexible seal member is associated with a portion of the inner wall section and includes a surface capable of diverting liquid into the channel.

In accordance with another aspect of the present disclosure, a head covering is provided. The head covering includes an inner wall section and an outer wall section disposed radially outwardly of the inner wall section and coupled thereto in order to form a channel. The head covering also includes means for sealing against the head of the user. The sealing means in some embodiments is configured for directing liquid into the channel.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Example embodiments of the present disclosure will now be described with reference to the accompanying drawings where like numerals correspond to like elements. Representative examples of the present disclosure are directed to head coverings, including but not limited to hats, visors, bandanas, etc., some suitable for use in outdoor applications. In particular, some embodiments of the present disclosure are directed to head coverings that provide, for example, protection from the elements, e.g., rain, wind, sun, while used in outdoor activities, including recreational activities (e.g., running, climbing, hiking, etc.), laborious activities (landscaping, construction, painting, etc.). Some embodiments of the present disclosure are further directed to head coverings having perspiration removal features.

The following discussion proceeds with reference to examples of head coverings with enhanced perspiration removal features. While these examples provided herein have been described in various details, it will be apparent to one skilled in the art that this is done for illustrative purposes only and should not be construed as limiting the scope of the claimed subject matter. Further, it will be appreciated that embodiments of the present disclosure may employ any combination of features described herein.

Figure 1:
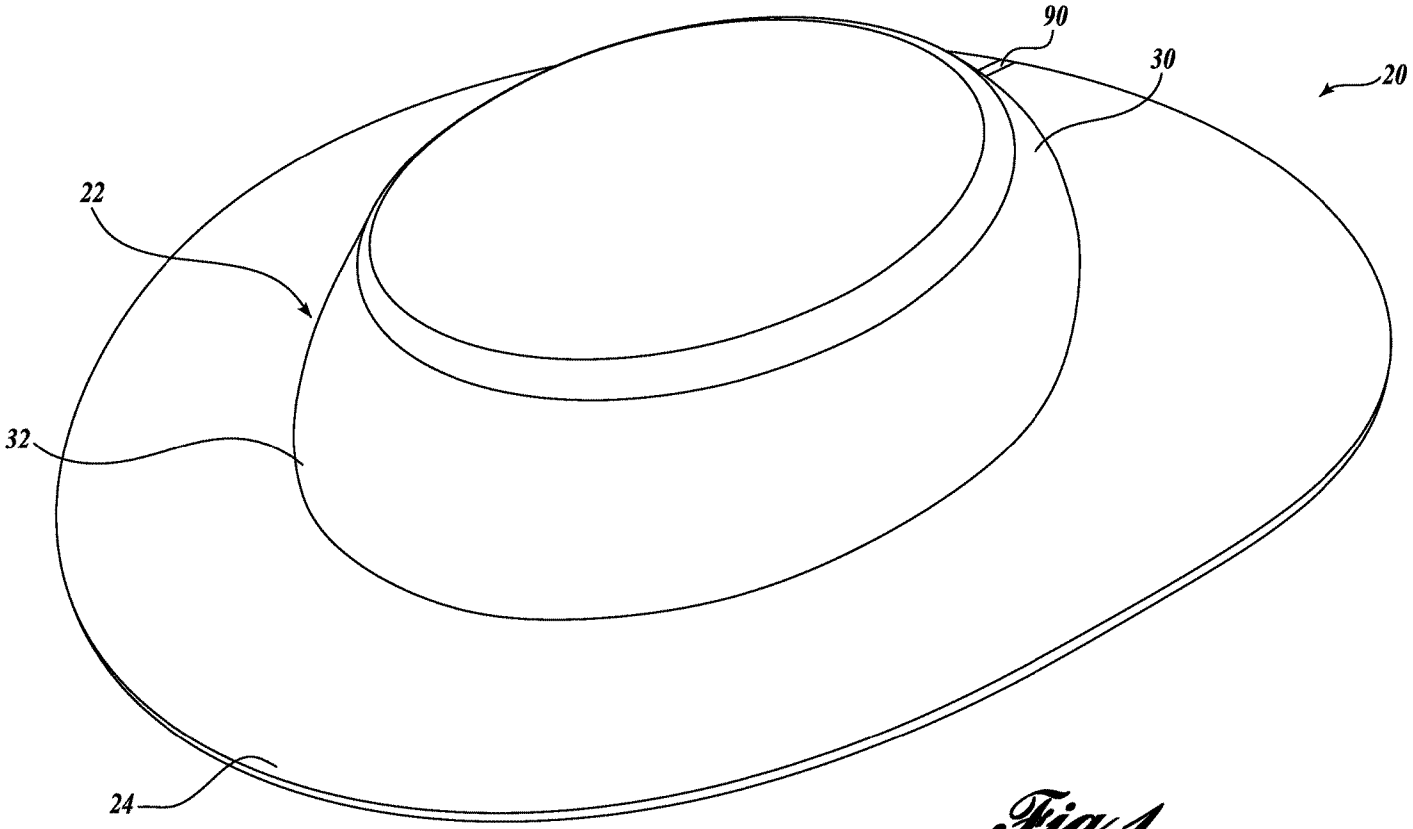
FIG. 1 is a perspective view of one example of a head covering, such as a hat, constructed in accordance with aspects of the present disclosure.
Figure 2:
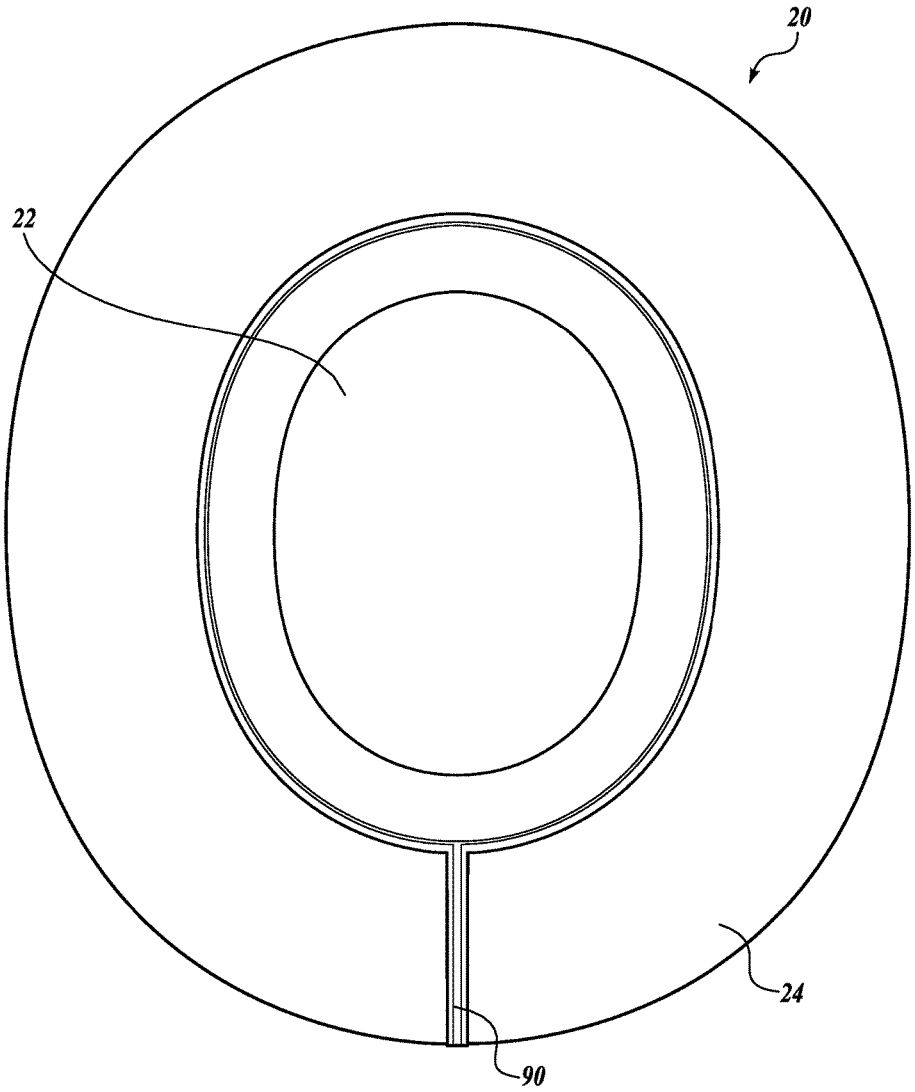
FIG. 2 is a top view of the hat of FIG. 1.
Figure 3:
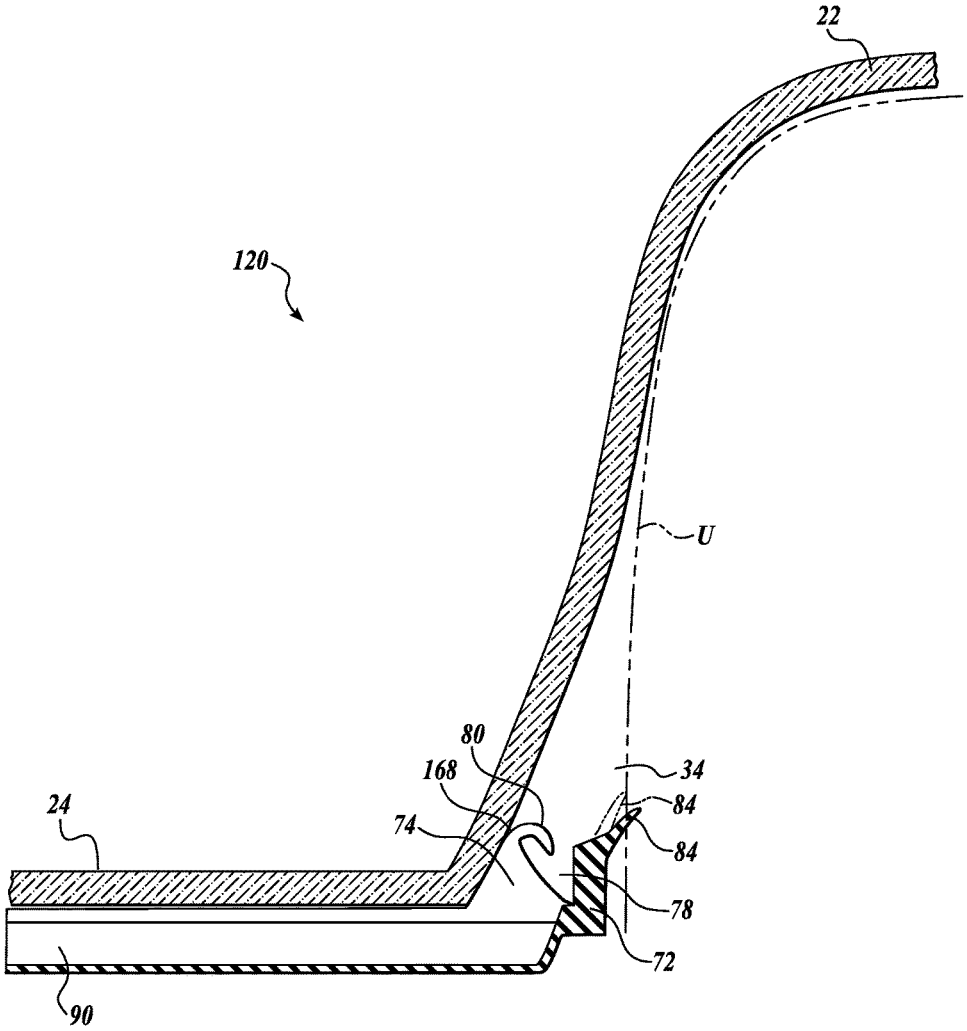
FIG. 3 is a partial cross-sectional schematic view of the hat of FIG. 1.

FIGS. 1-3 illustrate one representative embodiment of a head covering, generally designated 20, formed in accordance with aspects of the present disclosure. As shown in FIGS. 1-3, the head covering 20 is in the form of a hat (hereinafter "hat 20"), which includes a crown 22 and a brim 24. As will be described in more detail below, the hat 20 may include one or more perspiration removal features or systems (see FIG. 3).

Referring to FIGS. 1-3, the crown 22 of the hat 20 is formed with an upper crown portion 30 which extends across the top of the user's head and downwardly along the sides, the front, and the back of the user's head to a lower crown portion 32 which encircles the user's head. Extending outwardly therefrom in all directions is the brim 24, although other configurations where the brim extends outwardly along a portion or portions of the lower crown section 32 are possible. The brim 24 extends in a somewhat horizontal plane, although variations of this are within the scope of the claimed subject matter. In the embodiment shown in FIG. 3, the brim may be formed by a top layer 24A of suitable material and a bottom layer (not shown) of suitable material.

In embodiments of the present disclosure, the components of the hat may be constructed from any suitable material(s) utilized in the hat making industry. These materials may include, for example, fabrics constructed of natural fibers (e.g., cotton, wool, etc.), synthetic fibers (e.g., nylon, polyester, etc.), coated fibers, impregnated fibers, etc., and combinations, blends, etc., thereof. Some of the fabrics may be occlusive while others may have a degree of translucency or transparency. Other fabrics that may be used include mesh or other permeable membranes. Some may provide water repellency, water resistance, or water proofing. Other materials and/or layers may also be employed, including plastics, padding, etc.

In one embodiment, the top layer 24A is constructed of a waterproof or water resistant material or membrane, such as suitable plastics, rubber, Gore-Tex, etc. In another embodiment, such as, e.g., that shown in FIG. 4, the bottom layer 24B may be constructed of a breathable material, including but not limited to synthetic mesh fabrics. The bottom layer 24B may also be constructed out of a waterproof or water repellant material, or the like.

As constructed, the crown 22 and the brim 24 form a hat body that defines an open ended, inner cavity 34 for receiving the user's head U. An optional strap (not shown) extends beneath the hat 20 from either the crown 24 or the brim 26 for retaining the hat on the user's head. The strap may be any presently known or future developed strap capable of retaining the hat 20 on the user's head.

In accordance with an aspect of the present disclosure, the hat 20 further includes a perspiration removal system comprising a perspiration gutter 68 that is located adjacent the opening of the inner cavity 34 and, in some embodiments, formed integrally with the brim 24. The gutter 68 can extend around the inner perimeter of the lower crown section 32 or brim 24, or sections thereof (e.g., forehead section, side sections, etc.). The gutter 68 includes an inner wall portion 72 and an outer wall portion 74 that together forms a channel 78 for receiving and holding liquid. The top of the gutter outer wall 74 includes an inwardly projecting lip 80. Thus, the gutter 68 is configured to help prevent perspiration from coming out of channel 78 if the wearer were to bend over, shake their head, etc. In some embodiments, the gutter, or components thereof, is constructed of suitable plastics, synthetic or natural rubber, etc.

The perspiration removal system further includes a seal or skirt member 84 on the inner wall portion 72. The member 84 is a somewhat flexible member, and thus, is configured to move between an unbiased state, as shown in solid lines in FIG. 3, and a biased state when contacting the head of a user as shown in dashed lines in FIG. 3. In use, the member 84 aims to form a seal with the forehead or other head sections of the user. Once sealed, the member 84 directs perspiration over into the channel 78, preventing it from draining down in-between the brim 24 and the wearer's head, and possibly preventing such perspiration from getting into the wearer's eyes.

In the embodiment shown, the skirt member 84 is located above the perspiration gutter 68 and extends around the perimeter of the inner wall 72 or sections thereof. Likewise, the outer wall 72 of the perspiration gutter 68 extends around the inner perimeter of brim 24 or lower crown section 32 or sections thereof. Perspiration or other moisture (e.g., rain, etc.) that is collected in the channel 78 is channeled around to, for example, the back of the hat 20, and is collected in a conduit 90 at the rear of the hat. The conduit 280 extends outwardly from the inner wall to the outer edge of the brim 24 to deposit the liquid away from the wearer's head and body, as shown in FIGS. 2 and 3.

The hat 20 and/or perspiration removal system in some embodiments includes an outer layer (not shown) constructed of highly wicking material that covers the perspiration gutter 68 or portions thereof. In these and other embodiments, the outer layer can be constructed of suitable materials, such as fabric, plastic, or the like. In some embodiments, components of the hat 20, including the perspiration removal system, can be padded in suitable areas, to provide improved comfort to the user.

Figure 4:
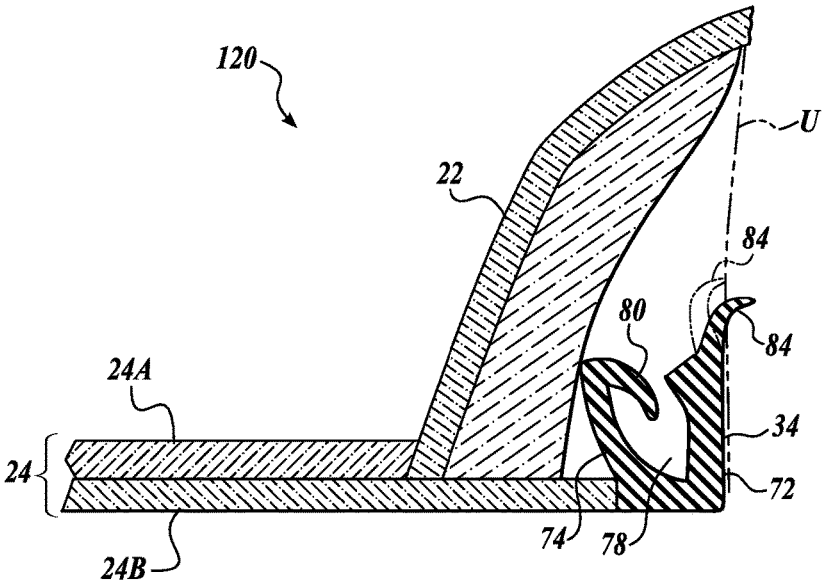
FIG. 4 is one example of a head covering, such as a visor, depicting a cross-sectional view of one embodiment of a perspiration removal system in accordance with aspects of the present disclosure.

It will be appreciated that aspects of the present disclosure may find use in other head coverings, such as visors (FIG. 4), hard hats (FIG. 5), bandanas (FIGS. 6-13), etc. In that regard, FIG. 4 illustrates another embodiment of a head covering, such as a visor 120, formed in accordance with aspects of the present disclosure. The visor 120 is substantially similar in construction and operation as the hat 20 except for the differences that will now be described in detail. In the embodiment shown, the brim 24 extends from a lower crown portion 32 in one section thereof, forming a bill-like feature of the visor. The lower crown portion 32 encircles the user's head or the front portion thereof, and defines an opening through which the user's head U extends. In this embodiment, the perspiration removal system or gutter 68 forms an inner band that extends around the user's head or front and/or side portions thereof. The inner wall 72 of the gutter 68 may optionally include padding, etc., for increased comfort to the user.

Figure 5:
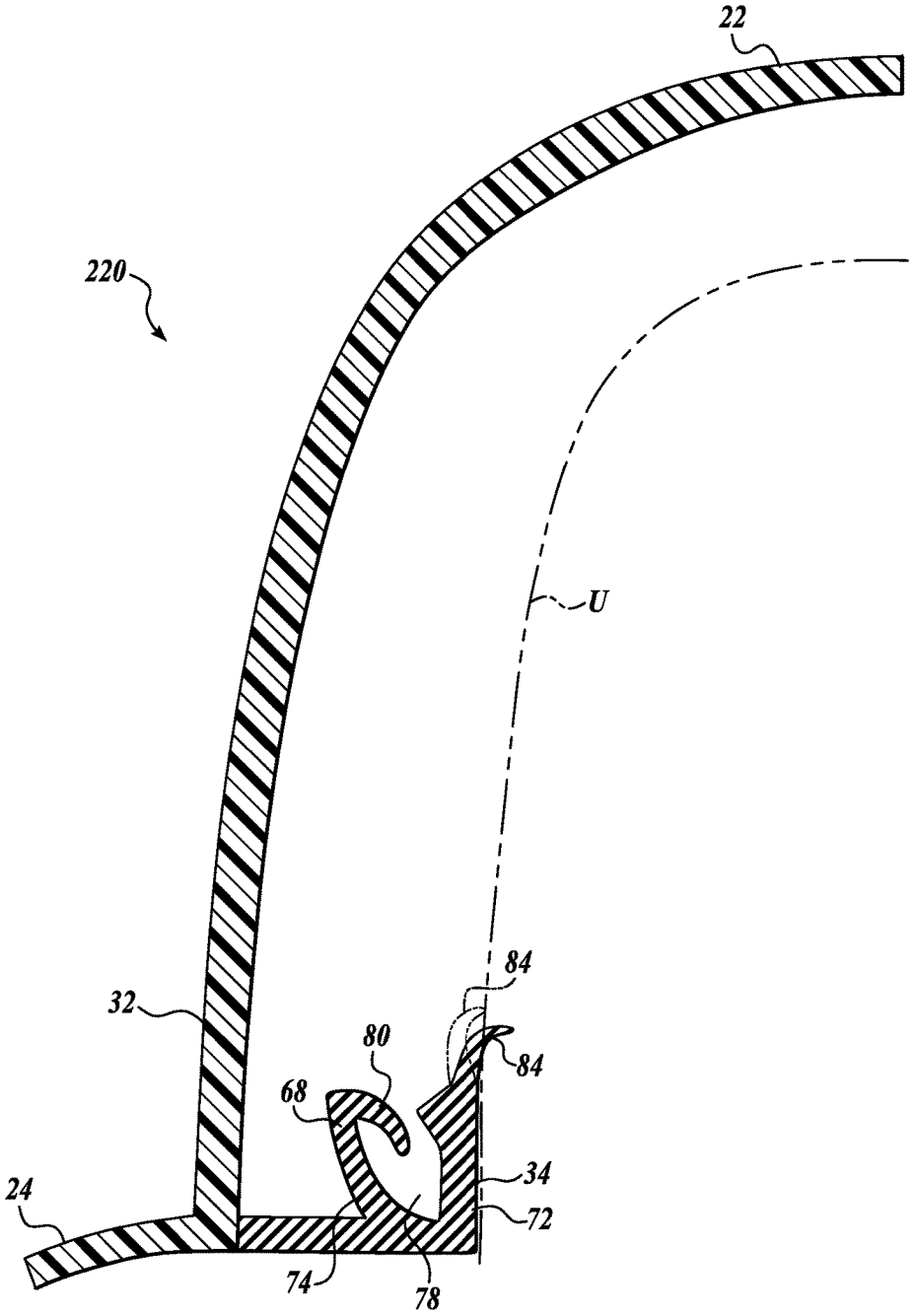
FIG. 5 is one example of a head covering, such as construction or "hard" hat, depicting a cross-sectional view of one embodiment of a perspiration removal system in accordance with aspects of the present disclosure.

In other embodiments, such as that of the hard hat of FIG. 5, the perspiration removal system may be encapsulated by a harder durometer plastic, to increase the rigidity of sections of the hat. In these and other embodiments, it will be appreciated that the seal member maintains flexible, with the ability to generate a biasing force against, for example, the direction of movement of the member.

Figure 6:
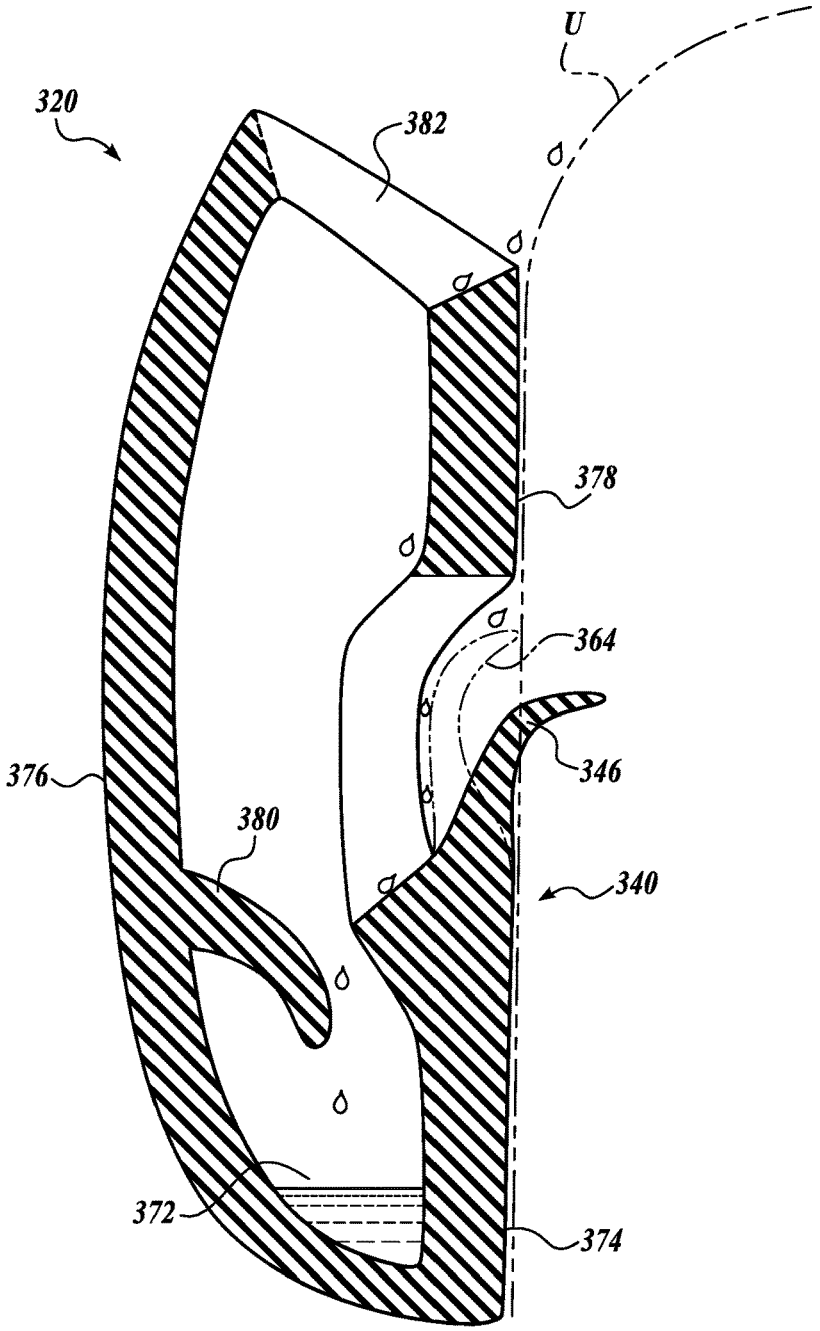
FIG. 6 is one example of a head covering, such as a bandana, depicting a cross-sectional view of one embodiment of a perspiration removal system in accordance with aspects of the present disclosure.
Figure 7:
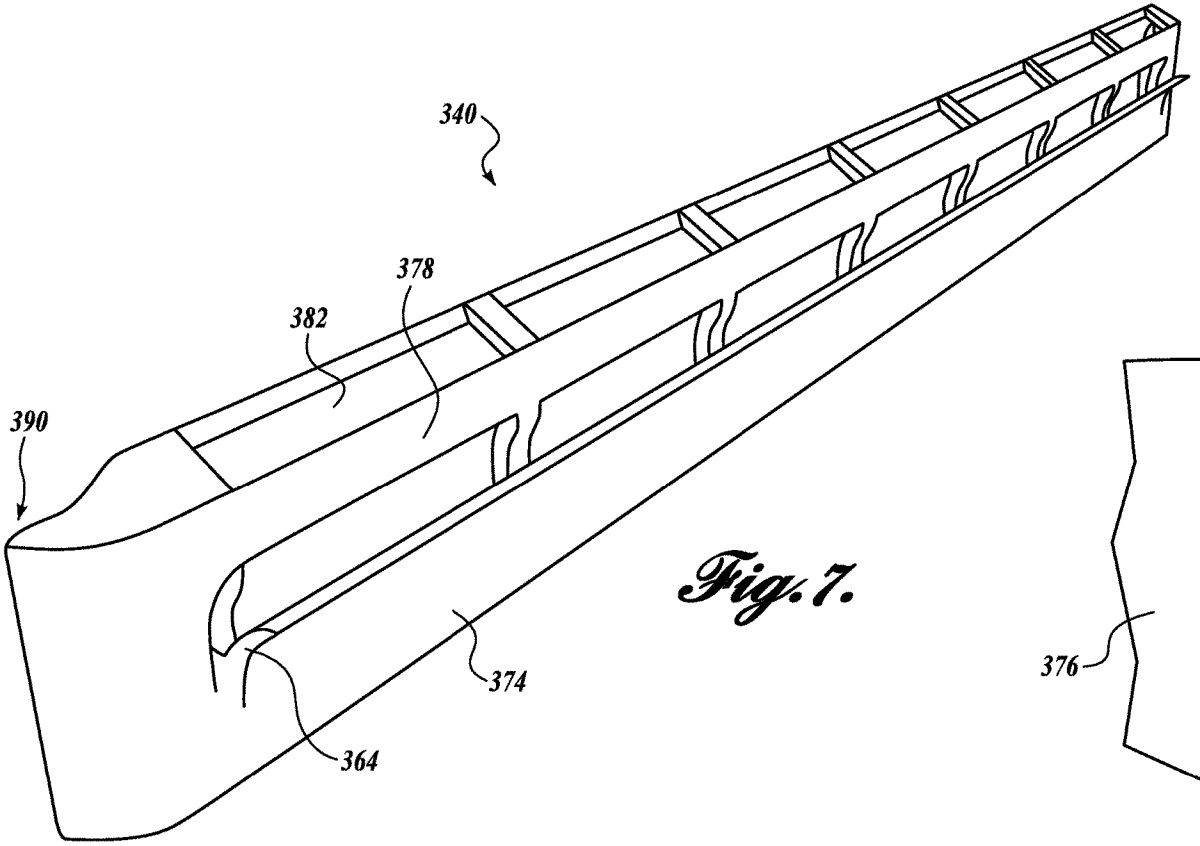
FIG. 7 is a perspective view of one example of the perspiration removal system of FIG. 6 in a linear configuration.
Figure 8:
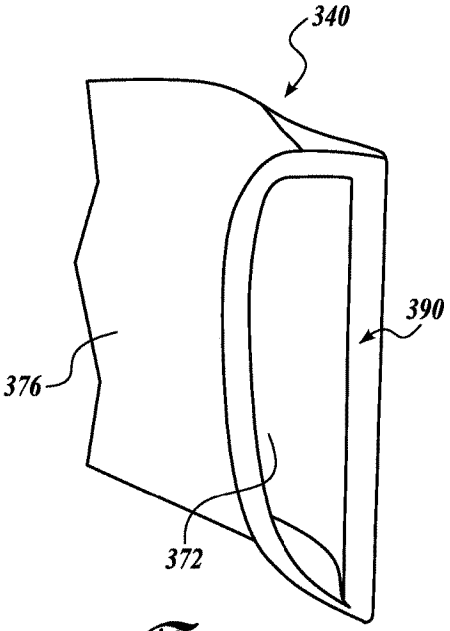
FIG. 8 is a partial end view of the perspiration removal system of FIG. 7.
Figure 9:
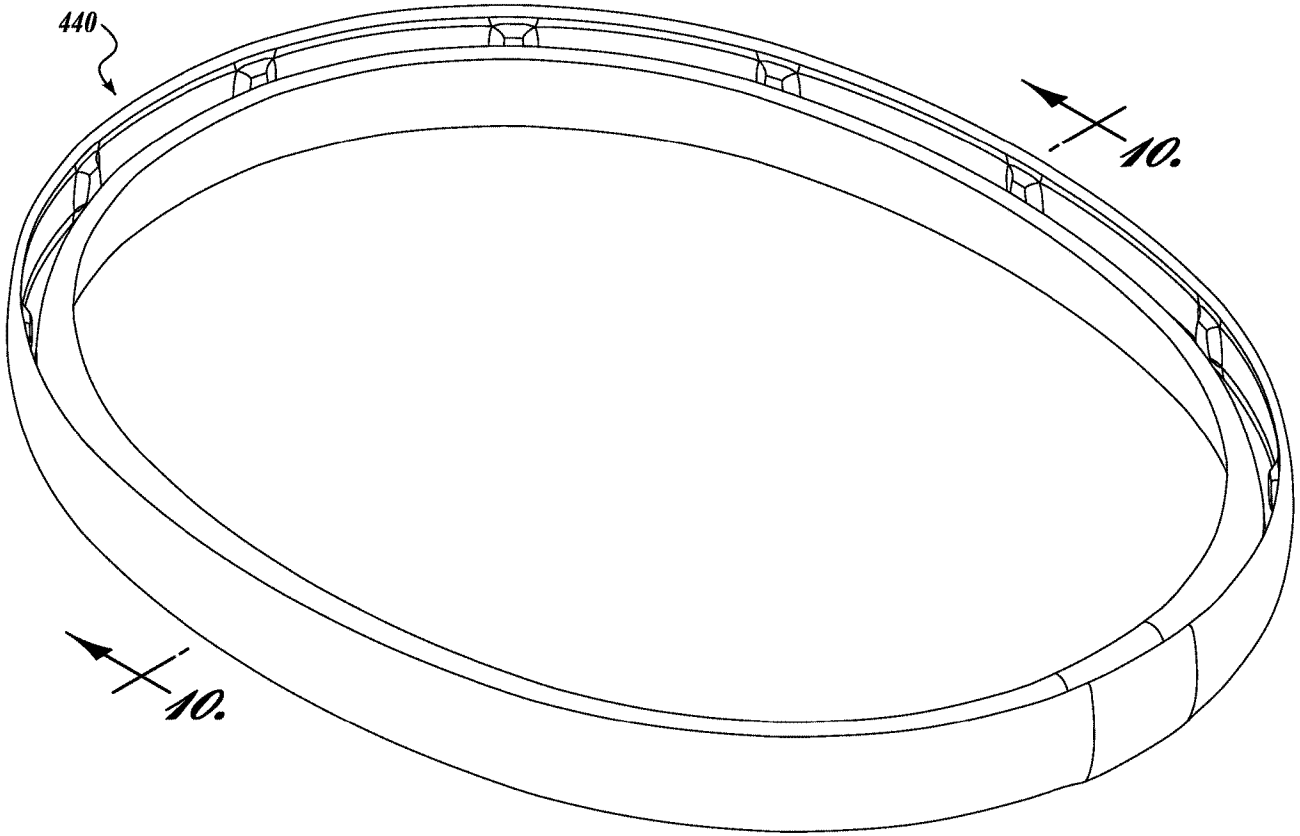
FIG. 9 is a perspective view of another example of a head covering, such as a bandana, including an embodiment of a perspiration removal system in accordance with aspects of the present disclosure.
Figure 10:
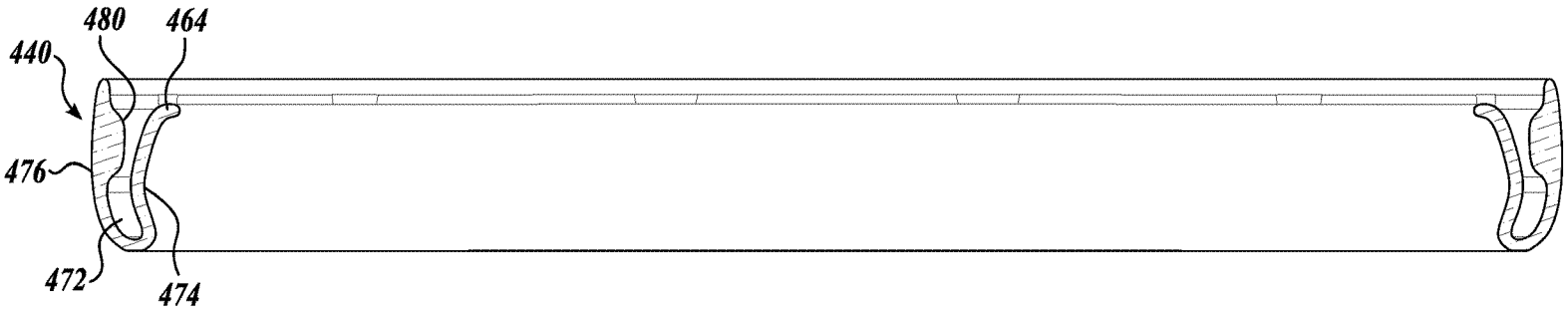
FIG. 10 is a cross-sectional view taken from the line 10-10 in FIG. 9.

In the embodiment of FIGS. 6-8, there is shown another example of a perspiration removal system 340 for removing moisture from the wearer. The perspiration removal system 340 may be suitable for use in a bandana 320, as shown in FIG. 6, or alternatively in a visor, such as the visor of FIG. 4 (where the brim 24 is in the form of a bill), a hat 20, as shown in FIGS. 1-3, a hard hat 220, as shown in FIG. 5, etc.

As shown in FIGS. 6-8, the perspiration removal system 340 includes a channel 372 formed between a lower inner wall section 374, which seats directly or indirectly against the forehead and/or other head sections of the user U, and an outer wall section 376. The channel 372 extends around the outer perimeter of the inner wall section 374 or sections thereof. The perspiration removal system 340 further includes a "seal" or "skirt" element or member 364 coupled to, integrally formed with, or otherwise disposed at the upper end of the inner wall section 374. In an unbiased state, the free end of the member 364 extends from the inner wall section 374 in a direction away from the channel 372. In some embodiments, the member 364 is a plastic cantilevered member with a free end for contacting the head of the user.

The member 364 is a somewhat flexible member, and thus, is configured to move between an unbiased state, as shown in solid lines in FIG. 6, and a biased state when contacting the head of a user as shown in dashed lines in FIG. 6. In use, the member 364 aims to form a seal with the forehead or other head sections of the user. In use, the member 364 aims to shelve water or perspiration over into the perspiration channel 372 in order to prevent it from draining down in between the inner wall and the wearer's head, and possibly, into the wearer's eyes. In the embodiment shown, the skirt member 364 extends around the perimeter of the inner wall section 374 or sections thereof.

The perspiration removal system 340 in some embodiments also includes an upper inner wall section 378 arranged and configured to seat directly or indirectly against the forehead of the user at a location above the seal member 364. In these embodiments, seal member 364 is disposed between the lower and upper inner wall sections so that the water or perspiration that falls down the user's forehead is directed into the channel 372 by skirt member 364. In some embodiments, the perspiration removal system 340 includes an upper gutter portion or deflector 380 configured to retard, and in some embodiments restrict or prevent, liquid from dumping out from the channel 372 if the person were to bend over. The perspiration removal system 340 may further include an aperture 382 at the top thereof.

The bandana 320 in some embodiments includes an outer layer or layers (not shown) constructed of, for example, a highly wicking fabric that covers the perspiration removal system 340 or portions thereof. In these and other embodiments, the system 340 can be constructed of suitable materials, such as fabric, plastic, or the like. Additionally, areas of the bandana 320 may be padded or the like.

Figure 11:
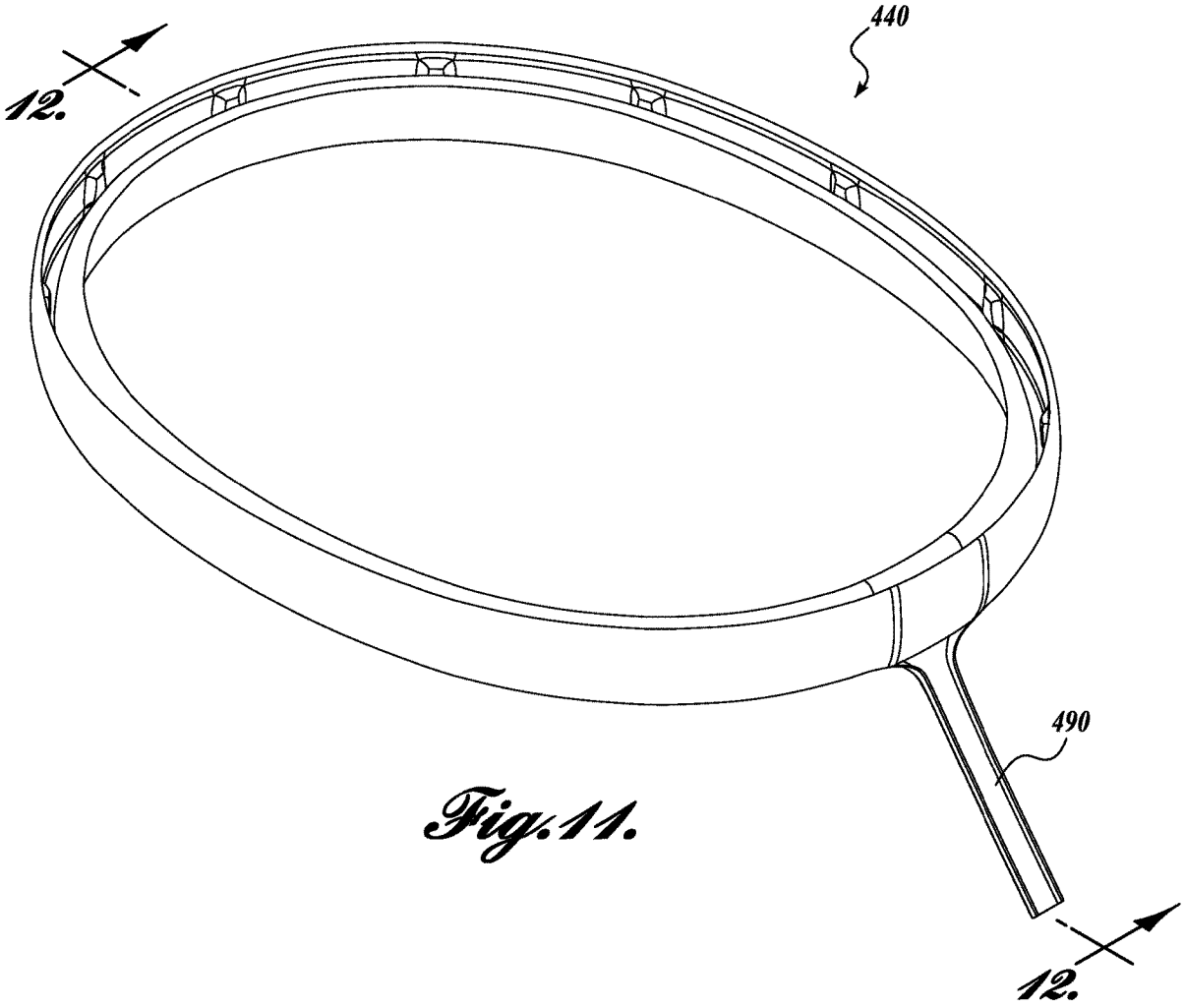
FIG. 11 is a perspective view of another example of a head covering, such as a bandana, including an embodiment of a perspiration removal system in accordance with aspects of the present disclosure.
Figure 12:
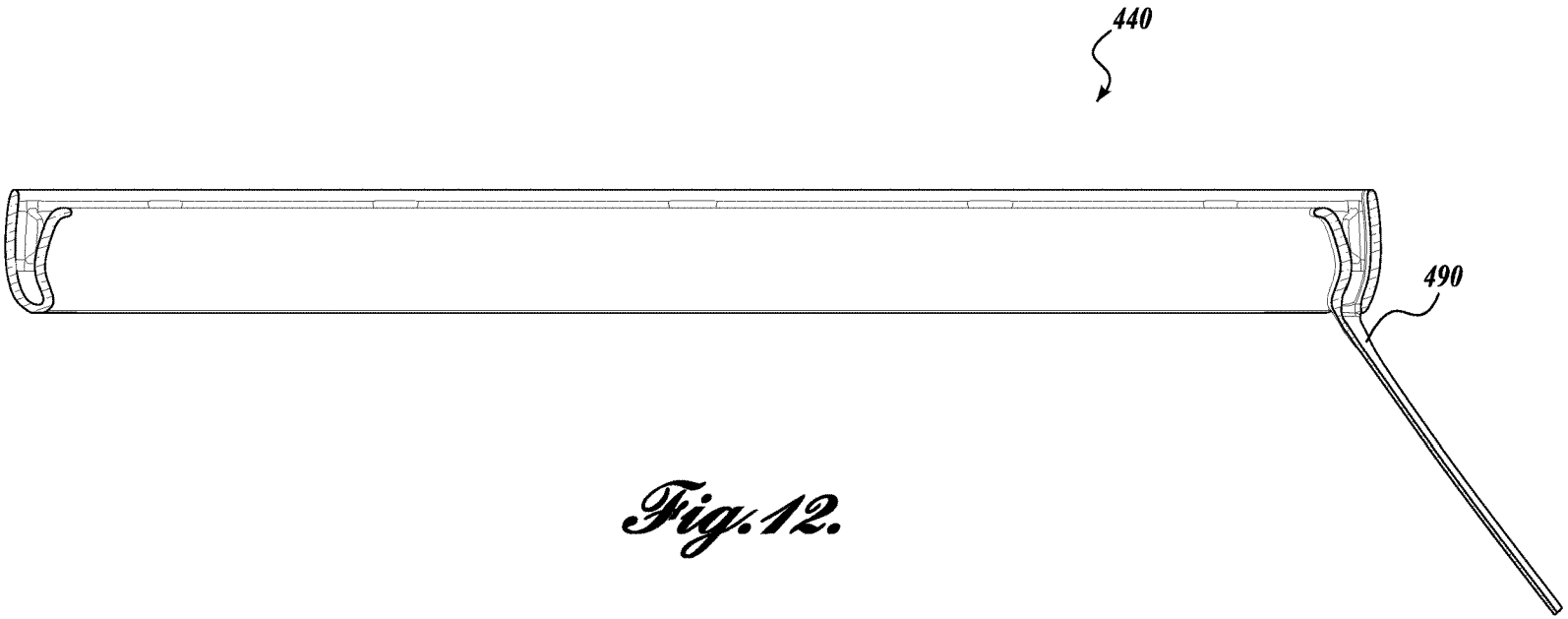
FIG. 12 is a cross-sectional view taken from the line 12-12 in FIG. 11.
Figure 13:
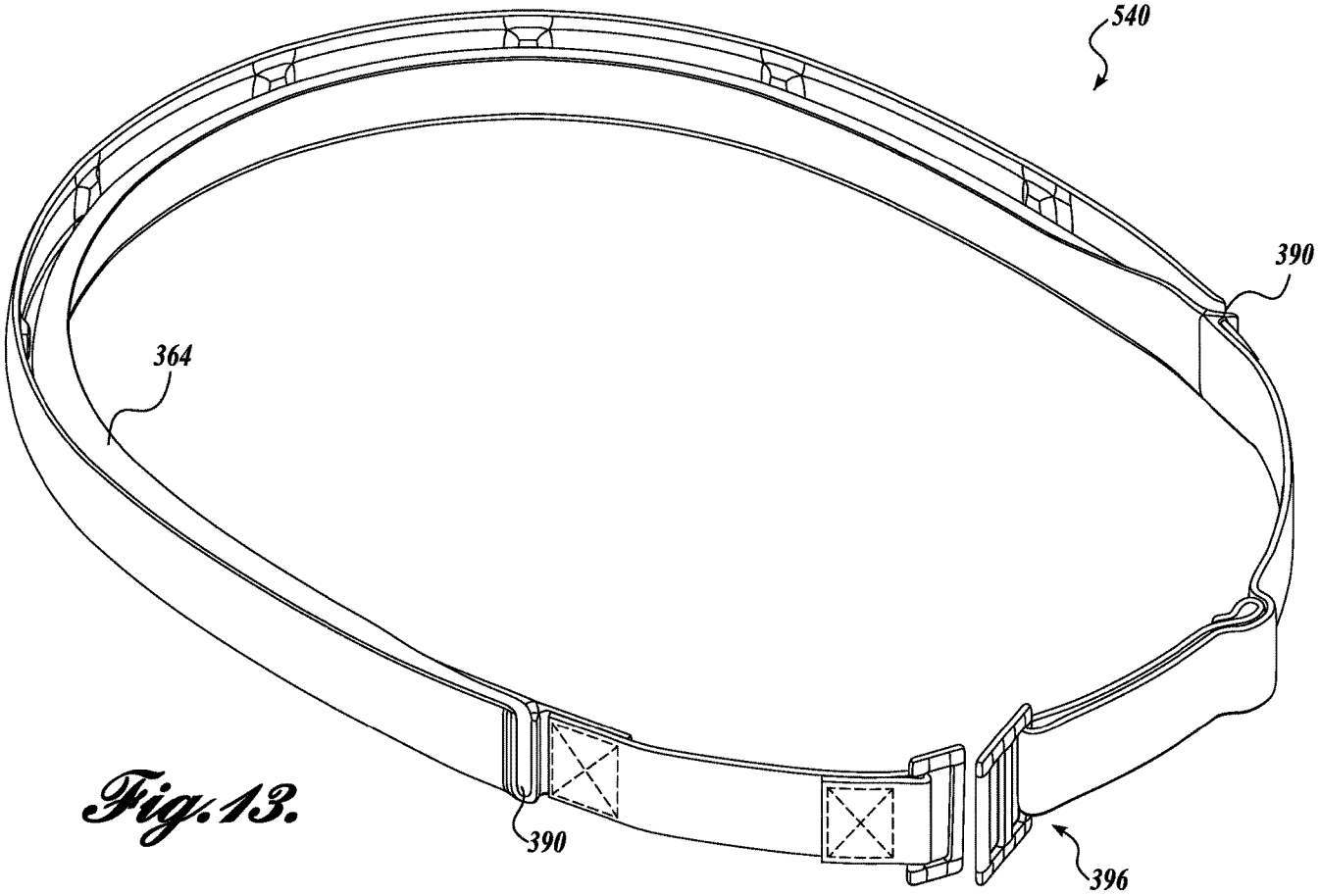
FIG. 13 is a perspective view of another example of a head covering, such as a bandana, including an embodiment of a perspiration removal system in accordance with aspects of the present disclosure.

Turning now to FIGS. 7 and 8, the perspiration removal system 340 is configured to channel perspiration or other moisture (e.g., rain, etc.) that has collected in the channel 372 to, for example, the back of the bandana 320, where it is diverted via a diverter 390 toward the outer wall 376 and continuing exteriorly of the bandana 320. In that regard, the diverter 390 can be formed by or coupled to the inner wall section 374 and extends outwardly to the outer wall section 374 to an opening 392. As such, the diverter is configured to deposit excess liquid away from the wearer's head. In another embodiment shown in FIG. 13, the diverter 390 is located on the side of the bandana 320. In this and other embodiments, including embodiments of the hat, visor, etc., the bandana may include an adjustable strap 396 or the like. In other embodiments, the diverter is in the form of a conduit 490, at the rear of the system 440, as shown in FIGS. 11-12. The conduit 490 extends outwardly from the inner wall to deposit the liquid away from the wearer's head and body similar to conduit 90 of FIGS. 2 and 3.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the claimed subject matter. Accordingly, it is expressly intended that all such variations, changes, and equivalents fall within the spirit and scope of the claimed subject matter.

The embodiments of the disclosure in which an exclusive property or privilege is claimed are defined as follows:

1. A head covering, comprising:

an inner wall section;

an outer wall section disposed radially outwardly of the inner wall section and coupled thereto in order to form a channel;

a flexible seal member associated with a portion of the inner wall section, the flexible seal having a surface capable of diverting liquid into the channel;

wherein the flexible seal element is configured to be moved between an unbiased state, in which the flexible seal extends inwardly of the inner wall section and into an open ended cavity for receiving a head of the user, and a biased state, in which the flexible seal element is in contact with the head of the user.

2. The head covering of claim 1, wherein a free end of the flexible seal member extends outwardly from the inner wall section in a direction away from the channel.

3. The head covering of claim 1, wherein the head covering is selected from the group consisting of a hat, a visor, a bandana, and a hard hat.

4. The head covering of claim 1, further comprising a deflector extending inwardly of the outer wall section into the channel, the deflector positioned a spaced distance above a bottom the channel.

5. The head covering of claim 1, further comprising means for directing the liquid collected in the channel to a location externally of the head covering.

6. The head covering of claim 1, further comprising a conduit connected in liquid communication with the channel, wherein the conduit is configured to direct the liquid collected in the channel to a location externally of the head covering.

7. The head covering of claim 1, further including one of a brim and a bill.

8. The head covering of claim 1, further comprising a crown defining an open ended cavity configured to receive a head of a user, wherein the outer crown wall is disposed adjacent a lower section of the crown.

9. The head covering of claim 1, further comprising a strap.

10. A head covering, comprising:

an inner wall section;

an outer wall section disposed radially outwardly of the inner wall section and coupled thereto in order to form a channel; and means for sealing against the head of the user, said means configured for directing liquid into the channel.

11. The head covering of claim 10, further comprising means for directing excess liquid collected in the channel to a location externally of the head covering.

12. A perspiration removal system wearable by a user, comprising:

an inner wall section;

an outer wall section disposed radially outwardly of the inner wall section and coupled thereto in order to form a channel;

a flexible seal member associated with a portion of the inner wall section, the flexible seal having a surface capable of diverting liquid into the channel;

wherein the flexible seal element is configured to be moved between an unbiased state, in which the flexible seal extends radially inwardly of the inner wall section and into the open ended cavity to a first position, and a biased state, in which the flexible seal element is positioned at a second position adjacent to a user and radially outwardly of said first position.

13. The perspiration removal system of claim 12, wherein a free end of the flexible seal member extends upwardly from the inner wall section in a direction away from the channel.

14. The perspiration removal system of claim 12, further comprising a deflector extending radially inwardly of the outer wall section and into the channel, the deflector positioned a spaced distance above a bottom the channel.

15. The perspiration removal system of claim 14, wherein the deflector also extends downwardly toward the bottom of the channel as the deflector extends radially inwardly of the outer wall section.

16. The perspiration removal system of claim 12, further comprising means for directing liquid collected in the channel to a location externally thereof.

17. The perspiration removal system of claim 12, further comprising a diverter connected in liquid communication with the channel, wherein the diverter is configured to divert liquid collected in the channel to a location externally thereof.

18. The perspiration removal system of claim 17, wherein the diverter extends radially outwardly of the outer wall section.

19. The perspiration removal system of claim 12, further comprising an outlet connected in liquid communication with the channel, the outlet providing egress of liquid collected in the channel.

20. The perspiration removal system of claim 12, further comprising a strap.

* * * * *